US005586662A

United States Patent [19]

Aikawa

[11] Patent Number: 5,586,662

[45] Date of Patent: Dec. 24, 1996

[54] BASKET FOR A PAPER-MAKING SCREEN AND METHOD FOR PRODUCING SAME

[75] Inventor: Yoshihiko Aikawa, Shizuoka, Japan

[73] Assignee: Aikawa Iron Works Co., Ltd., Shizuoka, Japan

[21] Appl. No.: 431,317

[22] Filed: Apr. 28, 1995

[51] Int. Cl.[6] ..... B07B 1/49

[52] U.S. Cl. ..... 209/411; 209/395; 210/485

[58] Field of Search ..... 209/273, 281, 209/300, 305, 306, 363, 393, 395, 406, 411, 409; 210/413, 485, 497.01

[56] References Cited

U.S. PATENT DOCUMENTS

| | | | |
|---|---|---|---|
| 2,850,165 | 9/1958 | Hesse et al. | 209/395 X |
| 3,804,246 | 4/1974 | Ljungqvist | 209/395 X |
| 5,094,360 | 3/1992 | Lange | 209/411 X |
| 5,190,161 | 3/1993 | Arai | 209/273 X |

FOREIGN PATENT DOCUMENTS

| | | | |
|---|---|---|---|
| 316570 | 5/1989 | European Pat. Off. | 209/395 |
| 1207690 | 9/1986 | Japan | 209/273 |
| 2233582 | 1/1991 | United Kingdom | 209/395 |

*Primary Examiner*—William E. Terrell
*Assistant Examiner*—Tuan Nguyen
*Attorney, Agent, or Firm*—Kanesaka & Takeuchi

[57] ABSTRACT

A basket for a paper-making screen is formed of a plurality of rod-shape members with a circular cross section, a first supporting member having a plurality of first receiving portions arranged annularly in predetermined constant intervals, and a second supporting member having a plurality of second receiving portions arranged annularly in predetermined constant intervals. The first and second supporting members are located on longitudinal end portions of the rod-shape members and fixed thereto. A space between the rod-shape members includes wide entrance and exit portions, and a narrow middle portion to thereby properly select paper materials through the spaces.

4 Claims, 4 Drawing Sheets

BASKET FOR A PAPER-MAKING SCREEN AND METHOD FOR PRODUCING SAME

BACKGROUND OF THE INVENTION AND RELATED ART STATEMENT

The present invention relates to a basket for a paper-making screen and a method for producing the same.

In a conventional paper-making screen, a screen plate is machined to form groove portions or paths. In order to allow fibers in paper materials to have directionality or an elongated shape by causing a turbulent flow with the screen plate, the groove portion has a complicated shape including a wide entrance portion, a narrow middle portion, and a wide exit portion in its cross section.

Therefore, in order to manufacture the above screen plate, the screen plate should be machined several times, which increases a production cost.

Also, if the screen plate is formed with wide opening areas to effectively select paper materials, an area between opening portions becomes too narrow, so that there has been a risk of producing cracks between the opening portions and the screen plate becomes weak.

In order to solve the problem, for example, Japanese Patent Publication (KOKOKU) No. 1-16959 was proposed. The invention includes special rod-shape members with various shapes, such as rhombus and triangle in a cross section, so that the rod shape members should be produced by drawing and the like, which is not suitable for ordinary or general use.

The object of the present invention is to provide a basket for a paper-making screen and a method for manufacturing the same without the conventional problems as mentioned above.

SUMMARY OF THE INVENTION

In order to attain the above object, a basket for a paper-making screen according to the present invention includes a plurality of rod-shape members having a circular cross section; a first supporting member having a plurality of receiving portions for the rod-shape members, which are formed annularly with spaces therebetween; and a second supporting member having a plurality of receiving portions for the rod-shape members, which are formed annularly with spaces therebetween. The first supporting member is disposed on one end sides of the rod-shape members, and the second supporting member is disposed on the other end sides thereof. The ends of the rod-shape members abut against the receiving portions of the first supporting member, and the other ends of the rod-shape members abut against the receiving portions of the second supporting member, wherein the abutted portions are fixed together.

Also, a method for producing the basket for the paper-making screen according to the present invention comprises: providing receiving portions for rod-shape members with a circular cross section annularly to first and second supporting members to have spaces therebetween; locating one ends of the rod-shape members to the first supporting member and the other ends thereof to the second supporting member, while abutting at the same time the rod-shape members against the receiving portions of the first and second supporting members at both ends; and fixing the abutted portions so that the rod-shape members and the first and second supporting members are united together.

In the method for producing the basket for the paper-making screen according to the present invention, the receiving portions are formed to have an arc-shape corresponding to a shape of the rod-shape members, and are formed outside the first and second supporting members. The rod-shape members abut against the receiving portions, and are fixed to the first and second supporting members.

Further, in the method for producing the basket for the paper-making screen according to the present invention, the receiving portions may be formed to have an arc-shape corresponding to a shape of the rod-shape members, and may be provided inside the first and second supporting members. The rod-shape members abut against the receiving portions, and are fixed to the first and second supporting members.

In the basket for the paper-making screen constituted as described above, the rod-shape members having an ordinary circular cross section can be used by arranging side by side, and the cross section of the rod-shape member arranged side by side has a wide entrance portion, a narrow middle portion and a wide exit portion.

Therefore, a turbulent flow is formed at the entrance portion, so that fibers in the paper material receive directionality and are guided to the exit portion through the middle portion.

DETAILED DESCRIPTION OF THE PREFERRED EMBODIMENTS

Figure 1:
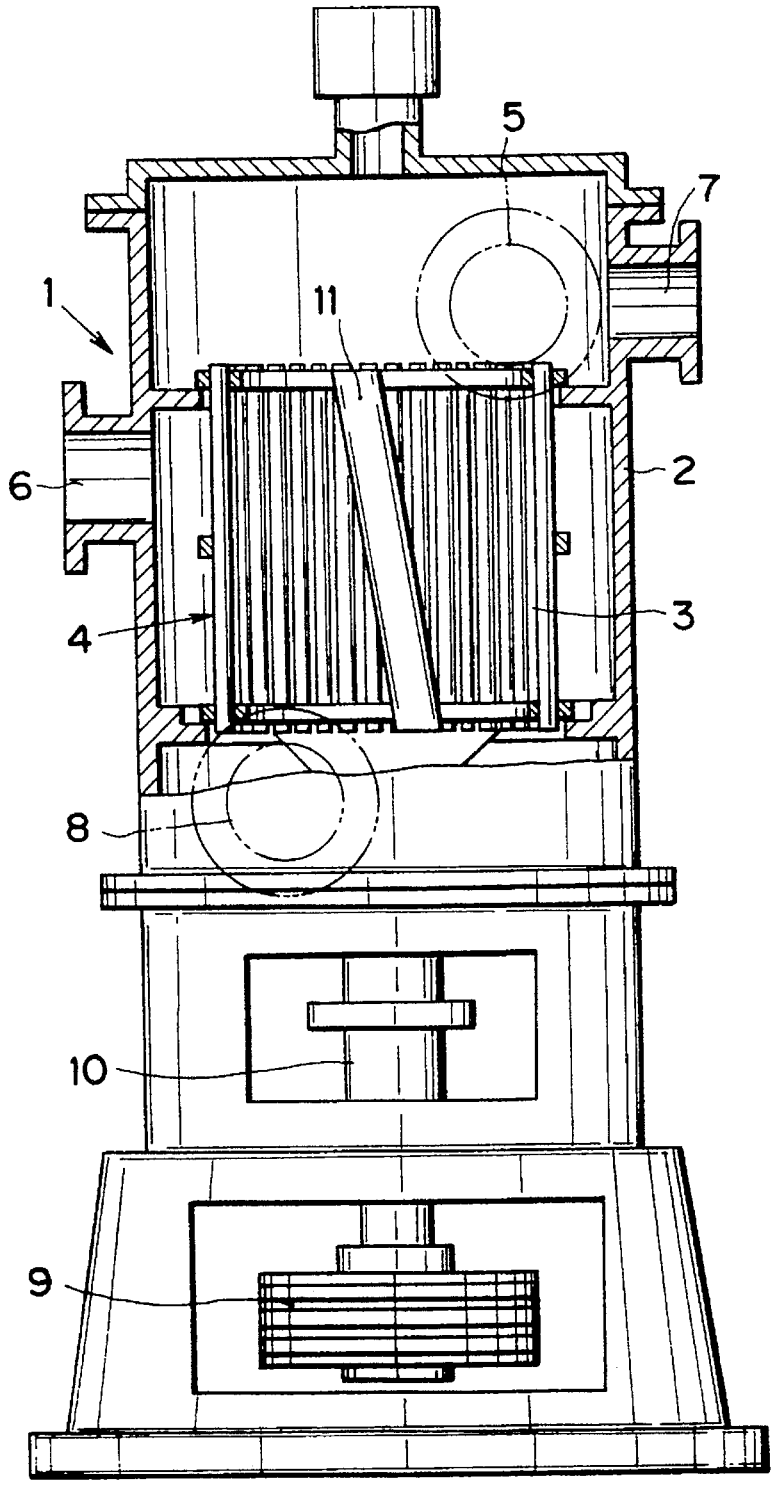
FIG. 1 is a partially cut front view of a pressure-type screen using a basket for a paper-making screen of a first embodiment according to the present invention.
Figure 2:
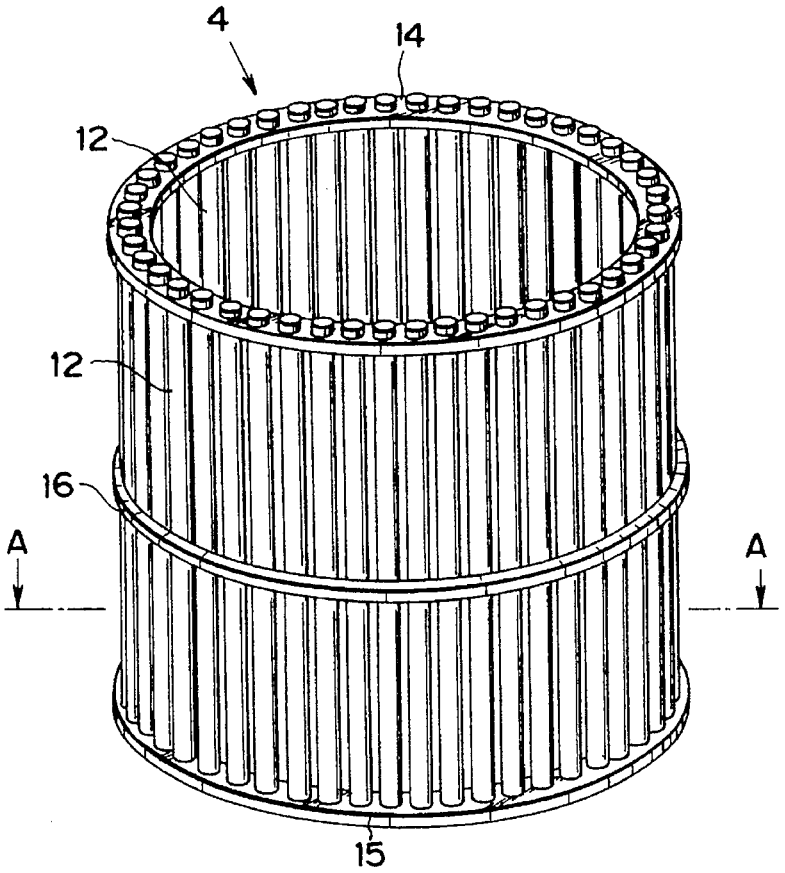
FIG. 2 is a perspective view of a first embodiment of the basket for the paper-making screen shown in FIG. 1.
Figure 3:
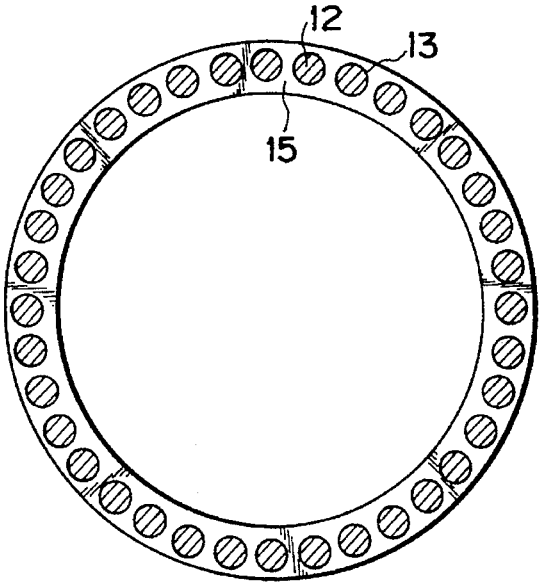
FIG. 3 is a section view taken along a line 3—3 in FIG. 2.

An embodiment according to the present invention is described referring to the drawings. In FIGS. 1 through 4, reference numeral 1 represents a pressure-type screen which is called as an outward flow screen. The pressure-type screen 1 is formed of a rotor 3 provided at an upper center in a casing 2, and a basket 4 for a paper-making screen provided on a lower stream side of the rotor 3 (hereinafter simply referred to as "basket").

Numeral 5 represents an entrance for a material, and a selected material is discharged through a material discharge port 6. Numeral 7 is an exit for light foreign materials, and numeral 8 is an exit for rejects.

The rotor 3 is rotated by a motor (not shown) through a belt, a receiving wheel 9 and a rotating shaft 10 fixed to the receiving wheel 9. The rotor 3 is provided on its side surface with an agitator 11.

The basket 4 is formed of stainless steel rod-shape members 12 having a circular cross section, a first supporting member 14 having receiving portions 13 for receiving the rod-shape members 12 arranged with intervals in a circular form, and a second supporting member 15 having receiving portions 13 for receiving the rod-shape members 12 arranged with intervals in a circular form. The first supporting member 14 is located at one end side of the rod-shape members 12, and the second supporting member 15 is located at the other end side of the rod-shape members 12. The rod-shape members 12 abut against the receiving portions 13 of the first supporting member 14 at the one end side, and against the receiving portions 13 of the second supporting member 15 at the other end side thereof, and the abutted portions are fixed by welding.

Although a diameter of the rod-shape members 12 is determined by a fiber length of the paper material, in order to prevent the fibers from crossing the rod-shape members 12, generally, the diameter is in a range of 2.5 mm to 6.0 mm. Also, the interval between the receiving portions 13 for receiving the rod-shape members 12 is selected such that the rod-shape members 12 are arranged with an interval of, for example, 0.2 to 0.60 mm therebetween. Incidentally, the space is determined by a size of foreign materials to be removed from the paper material. In the embodiment shown in FIGS. 2 through 4, the receiving portion 13 is formed of a circular opening with a diameter slightly larger than that of the rod-shape member 12.

Incidentally, although it is sufficient that the rod-shape members 12 are supported by, at least, the first supporting member 14 at one end side and the second supporting member 15 at the other end side, the rod-shape members 12 may be supported by a third supporting member 16 provided in the middle of the first and the second supporting members 14, 15, or by another supporting member which is not shown.

In a method for producing the basket for the paper-making screen, the receiving portions 13 for receiving the rod-shape members 12 having a circular cross section are respectively provided on the first and second supporting members 14, 15 in a circular shape with an interval therebetween. The first supporting portion 14 is located on one end side of the rod-shape members 12 and the second supporting portion 15 is located on the other end side thereof, while at the same time the rod-shape members 12 abut against the respective receiving portions 13 arranged on the first supporting member 14 and the second supporting member 15. The abutted portions are fixed so that the rod-shape members 12 and the first and the second supporting members 14, 15 are integrally connected.

Figure 4:
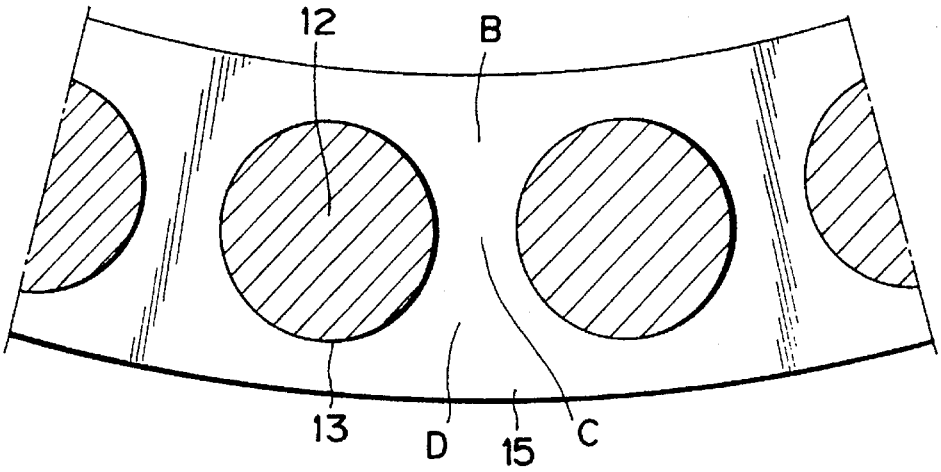
FIG. 4 is an enlarged section view of a part of FIG. 3.

Therefore, when the pressure-type screen 1 is operated, a material supplied through the material entrance 5 is selected through the spaces between the respective rod-shape members 12 provided on the basket 4 upon rotation of the rotor 3. In a cross section of the rod-shape members 12 provided side by side, as shown in FIG. 4, an entrance portion B is formed wide, a middle portion C becomes narrow, and an exit portion D is enlarged.

As a result, a turbulent flow is formed at the entrance portion B, by which fibers are guided through the middle portion C to the exit portion D.

Figure 5:
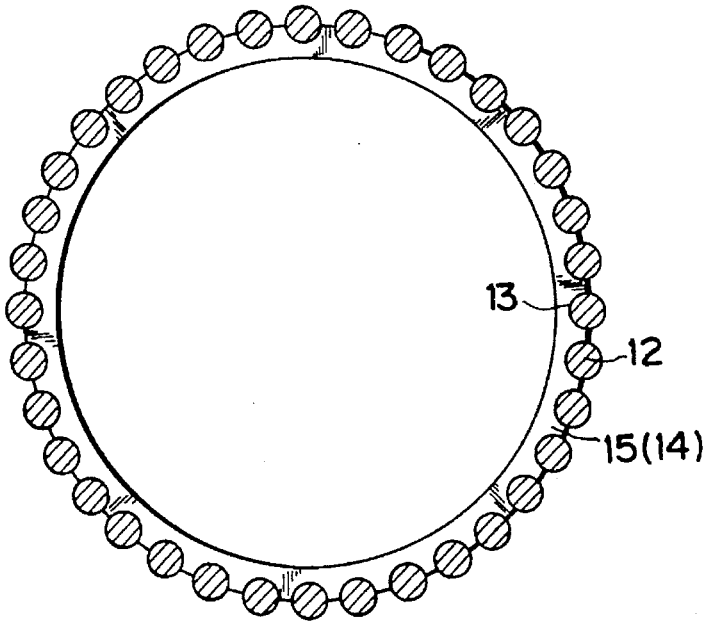
FIG. 5 is a section view of a second embodiment of a basket of the invention.
Figure 6:
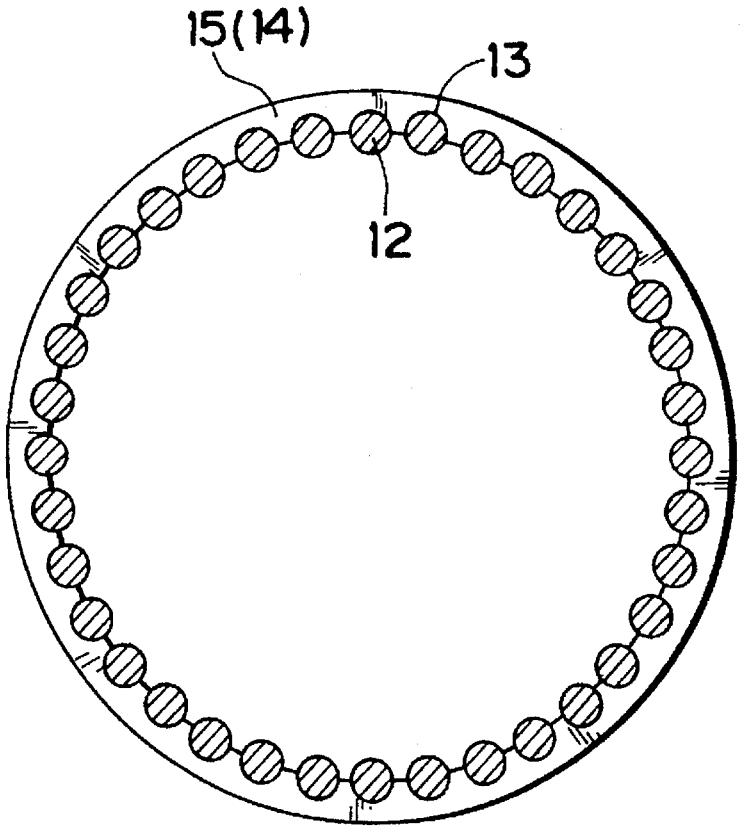
FIG. 6 is a section view of a third embodiment of a basket of the invention.

Incidentally, in the above-mentioned embodiment, the receiving portions 13 of the basket 4 are circular openings with a diameter slightly larger than a diameter of the rod-shape members 12, and are provided to the first, second and third supporting members 14, 15, 16. In the present invention, however, as shown in FIG. 5, arc shape receiving portions 13 corresponding to the shape of the rod-shape members 12 may be arranged outside the first and second supporting members 14, 15. The rod-shape members 12 abut against the receiving portions 13, and the rod-shape members 12 are fixed to the first and second supporting members 14, 15. Also, as shown in FIG. 6, arc shape receiving portions 13 corresponding to the shape of the rod-shape members 12 may be arranged inside the first and second supporting members 14, 15. The rod-shape members 12 abut against the receiving portions 13, and the rod-shape members 12 are fixed to the first and second supporting members 14, 15.

Further, in the present embodiment, description has been made on an outward flow screen, wherein the rotor 3, such as a rotational hydrofoil, rotates inside the screen plate, i.e. on an entrance side of a material, so that the material flows from the inside of the screen plate to the outside to select the material. However, the present invention can also use for an inward flow screen, wherein the rotational hydrofoil rotates outside the screen plate, i.e. on an entrance side of a material, so that the material flows from the outside of the screen plate to the inside of the screen plate to select the material.

The basket for the paper-making screen according to the present invention includes the rod-shape members with a circular cross section, the first supporting member provided, in a circular shape, with the receiving portions for the rod-shape members with a space therebetween, and the second supporting member provided, in a circular shape, with the receiving portions for the rod-shape members with a space therebetween. The first supporting member is located on one end side of the rod-shape members, and the second supporting member is located on the other end side of the rod-shape members. The rod-shape members abut against the respective receiving portions provided on the first supporting member and the second supporting member on both ends thereof, and the butted portions are fixed together. Therefore, in the present invention, the ordinary rod-shape members with a circular cross section are used and arranged side by side without using specific rod-shape members used in a conventional basket. Also, when the rod-shape members are disposed side by side, it is possible to easily obtain the structure such that an entrance portion is formed wide, a middle portion is narrow, and an exit portion is enlarged.

In the method for producing the basket for the paper-making screen according to the present invention, instead of using a special rod-shape members used in the conventional basket, the basket can be produced by arranging the ordinary rod-shape members with a circular cross section side by side, and it is possible to easily obtain the structure with a wide entrance portion, a narrow middle portion and an enlarged exit portion. According to the present invention, the complicated structure can be easily obtained at a low cost.

In the invention, when the arc-shape receiving portions corresponding to shapes of the rod-shape members are formed inside or outside the first and second supporting members, the rod-shape members can be easily fixed to the first and second supporting members. Thus, positioning of the rod-shape members can be easily and quickly carried out, and the basket for the paper-making screen can be manufactured with an accurate pitch between the respective rod-shape members.

What is claimed is:

1. A basket for a paper-making screen consisting essentially of:

a plurality of rod-shape members, each having a circular cross section;

a first annular supporting member having a plurality of first receiving portions arranged annularly in predetermined constant intervals, each first receiving portion being formed of a circular hole slightly larger than a diameter of the rod-shape member and located in a center of the first annular supporting member in a direction of the width; and a second annular supporting member having a plurality of second receiving portions arranged annularly in constant intervals as in the first receiving portions, each second receiving portion being formed of a circular hole having a size as in the first receiving portion and located in a center of the second annular supporting member in a direction of the width, longitudinal end portions of said rod-shape members being located in the circular holes of the first and second annular supporting members and fixed thereto so that a space between the rod-shape members includes wide entrance and exit portions, and a narrow middle portion to thereby select paper materials through the spaces, said first and second annular supporting members having same widths and being connected only to the rod-shape members.

2. A basket as claimed in claim 1, wherein the rod-shape member has a diameter in a range of 2.5 mm to 6.0 mm, and the space at the narrow middle portion is in a range of 0.2 to 0.60 mm.

3. A basket for a paper-making screen consisting essentially of:

a plurality of rod-shape members, each having a circular cross section;

a first annular supporting member having a plurality of first receiving portions arranged annularly in predetermined constant intervals, each first receiving portion being formed of a circular hole slightly larger than a diameter of the rod-shape member and located in a center of the first annular supporting member in a direction of the width;

a second annular supporting member having a plurality of second receiving portions arranged annularly in constant intervals as in the first receiving portions, each second receiving portion being formed of a circular hole having a size as in the first receiving portion and located in a center of the second annular supporting member in a direction of the width, longitudinal end portions of said rod-shape members being located in the circular holes of the first and second annular supporting members and fixed thereto so that a space between the rod-shape members includes wide entrance and exit portions, and a narrow middle portion to thereby select paper materials through the spaces, said first and second annular supporting members having same widths and being connected only to the rod-shape members; and a third supporting member situated between the first and second supporting members to support the rod-shape members.

4. A basket as claimed in claim 3, wherein the rod-shape member has a diameter in a range of 2.5 mm to 6.0 mm, and the space at the narrow middle portion is in a range of 0.2 to 0.60 mm.

* * * * *